US010388481B2

(12) United States Patent
Lell

(10) Patent No.: US 10,388,481 B2
(45) Date of Patent: Aug. 20, 2019

(54) DISCONNECTING SWITCH FOR HIGH DIRECT OR ALTERNATING CURRENTS AT HIGH VOLTAGE

(71) Applicant: Peter Lell, Moosburg (DE)

(72) Inventor: Peter Lell, Moosburg (DE)

(73) Assignee: Peter Lell, Moosburg (DE)

( * ) Notice: Subject to any disclaimer, the term of this patent is extended or adjusted under 35 U.S.C. 154(b) by 0 days.

(21) Appl. No.: 15/520,668

(22) PCT Filed: Oct. 21, 2015

(86) PCT No.: PCT/DE2015/100439
§ 371 (c)(1),
(2) Date: Apr. 20, 2017

(87) PCT Pub. No.: WO2016/062305
PCT Pub. Date: Apr. 28, 2016

(65) Prior Publication Data

US 2017/0309432 A1 Oct. 26, 2017

(30) Foreign Application Priority Data

Oct. 22, 2014 (DE) ..... 10 2014 115 396

(51) Int. Cl.
*H01H 1/00* (2006.01)
*H01H 33/36* (2006.01)
(Continued)

(52) U.S. Cl.
CPC ..... *H01H 85/10* (2013.01); *H01H 33/36* (2013.01); *H01H 39/006* (2013.01); *H01H 85/18* (2013.01); *H01H 1/00* (2013.01)

(58) Field of Classification Search
CPC ..... H01H 33/36; H01H 1/66; H01H 39/006; H01H 39/002; H01H 39/00; H01H 85/10;
(Continued)

(56) References Cited

U.S. PATENT DOCUMENTS 462,033 A * 10/1891 Cleveland ..... H01H 33/76 218/89
4,048,610 A * 9/1977 Jacobs, Jr. ..... H01H 85/42 337/165
(Continued)

FOREIGN PATENT DOCUMENTS

CH 240670 A 1/1946
DE 1050858 B1 2/1959
(Continued)

OTHER PUBLICATIONS

Translation of DE102014110825 (U.S. 20170229267 published Aug. 2017).*
(Continued)

*Primary Examiner* — Edwin A. Leon
*Assistant Examiner* — William A Bolton
(74) *Attorney, Agent, or Firm* — Dickinson Wright PLLC

(57) ABSTRACT

A switch (10), particularly a disconnecting switch (10) for high direct currents and alternating currents at high voltages, can be transferred from a conducting position into a disconnecting position. The switch (10) is includes a housing (12), a first contact (28), a second contact (30), a switching piston (24) guided by the housing (12) with a connecting element (22), which establishes an electrical connection in the connecting position between the first contact (28) and the second contact (30). The housing (12) defines an interior space surrounding the connecting element (22). The connecting element (22) extends at least partially in the interior space (18) and is filled with an insulating medium (20), and the switch is designed such that a mechanical movement of the switching piston (24) transfers the switch (10) from the connecting position into the disconnecting position. The switching piston (24) mechanically impacts the connecting element (22) such that the electrical connection between the
(Continued)

first contact (28) and the second contact (30) is interrupted in at least one disconnecting location.

14 Claims, 9 Drawing Sheets

(51) Int. Cl.
*H01H 39/00* (2006.01)
*H01H 85/10* (2006.01)
*H01H 85/18* (2006.01)

(58) Field of Classification Search
CPC ..... H01H 85/18; H01H 3/22; H01H 3/222; H01H 3/28; H01H 3/245; H01H 2039/008; H01H 85/02; H02H 5/04
USPC ..... 218/150, 45, 67, 57, 60, 61, 79, 80, 89, 218/90, 95, 111
See application file for complete search history.

(56) References Cited

U.S. PATENT DOCUMENTS

| | | | | | |
|---|---|---|---|---|---|
| 4,224,491 | A * | 9/1980 | Kroon | H01H 39/00 | 218/95 |
| 4,324,978 | A * | 4/1982 | Kalender | A61B 6/032 | 378/10 |
| 7,222,561 | B2 * | 5/2007 | Brede | B23D 15/145 | 83/639.4 |
| 7,528,332 | B1 | 5/2009 | Via et al. | | |
| 8,446,241 | B2 * | 5/2013 | Filiputti | H01H 39/00 | 335/185 |
| 8,492,672 | B2 * | 7/2013 | Shea | H01H 39/004 | 218/118 |
| 2010/0181182 | A1 * | 7/2010 | Gentsch | H01H 39/00 | 200/82 R |
| 2013/0170088 | A1 * | 7/2013 | Willer | H01H 37/76 | 361/103 |
| 2017/0229267 | A1 * | 8/2017 | Lell | H01H 39/00 | |

FOREIGN PATENT DOCUMENTS

| | | | | | |
|---|---|---|---|---|---|
| DE | 1928922 | C3 | | 12/1970 | |
| DE | 69216563 | T2 | | 4/1997 | |
| DE | 19819662 | A1 | | 11/1998 | |
| DE | 19749133 | A1 | | 5/1999 | |
| DE | 10205369 | B4 | | 3/2004 | |
| DE | 202007013841 | U1 | | 1/2008 | |
| DE | 102009056865 | A1 | | 6/2011 | |
| DE | 112011105423 | T5 | | 4/2014 | |
| DE | 102014110825 | A1 | | 9/2014 | |
| EP | 1514287 | A1 | | 3/2005 | |
| EP | 2073235 | A1 | * | 6/2009 | H01H 39/00 |
| FR | 646257 | A | | 11/1928 | |
| GB | 984266 | A | | 2/1965 | |
| JP | S49024742 | B | | 6/1974 | |
| JP | 2009099559 | A | | 5/2009 | |
| JP | 2014049272 | A | | 3/2014 | |
| WO | WO2011067132 | | * | 6/2011 | H01H 39/006 |

OTHER PUBLICATIONS

Translation of WO2011067132 (Original doc. published Jun. 2011).*
Translation of EP2073235 (Original doc. published Jun. 2009).*
International Search Report to corresponding PCT/DE2015/100439 dated Apr. 25, 2017.

* cited by examiner

DISCONNECTING SWITCH FOR HIGH DIRECT OR ALTERNATING CURRENTS AT HIGH VOLTAGE

CROSS REFERENCE TO RELATED APPLICATIONS

This application claims the benefit of PCT International Application Serial No. PCT/DE2015/100439 filed on Oct. 21, 2015, which claims priority to DE 10 2014 115 396.0 filed on Oct. 22, 2014, the entire disclosures of which are incorporated herein by reference.

FIELD OF THE INVENTION

The present invention relates to a switch, in particular to a disconnecting switch. This switch can disconnect high direct or alternating currents at high voltages, and it can be used for example in a voltage range between 100 V and 5,000 V. In this manner, electrical currents of 10,000 A can be thus be disconnected.

BACKGROUND OF THE INVENTION

The switching of circuits for currents with a higher output, which is to say at high voltages and/or high currents, is a challenge in the entire field of electrical engineering. This problem is encountered in particular when switching off high direct currents, which when compared to alternating currents, do not have zero crossings that can form with a sufficiently high voltage a light arc, which can for formed and remain stable at approximately 100 V of source voltage and consume all the materials in their environment. With the combustion and ionization of the current-conducting contacts or electrodes, the current can continue to flow in the light arc in this case, although the current circuit is already mechanically disconnected by the switch, or should be disconnected. Various approaches are know that can be used in order to avoid these problems. Some of these approaches are also about the speed of the separation process.

Swiss patent CH 24 06 70 discloses a device for connecting and disconnecting electrical current circuits in which high potentials occur. The patent discloses that a contact element conducting a high voltage can be covered with a metallic shield cover. The contact conductor element can be provided with a plurality of individual contact conductors and accordingly, the metallic shield cover is provided with a number of openings corresponding to the number of the contact conductors. The shield cover is mechanically connected with the contact conductors, so that at the approach of a second contact, the opposite contact conductor is moved back and the contact conductors that were up until that point shielded are only then released through the openings. This switching device should be used in particular in power amplifiers of long-wave transmitters.

It will be appreciated that the formation of light arcs is complicated by the shield cover, but what is also apparent is that their formation cannot be suppressed completely in any case at a sufficiently high voltage. The mechanical design is also not very suitable for a very fast connection or disconnection of an electrical circuit. Moreover, it is effective only with relatively high-frequency currents.

The German patent document DE 19 28 922 C3 discloses an approach to high-voltage technology that also emphasizes mechanical separation of electrical circuits. The current is conducted through one or several disconnecting knives, which can be safely moved mechanically into a mating switch. The disconnecting knives can be additionally also rotated to obtain a better and more reliable electrical contact with the mating switch. This approach makes it possible to use very high voltages in the range of more than 10 kV, and even more than 100 kV. However, the mechanical separation is again quite slow, and in addition, mechanically complicated component parts must be provided, which also take up space in the design.

The German publication of examined patent application 1 050 858 discloses en electrical circuit breaker in the form of an explosive insulator. The explosive insulator is equipped with a chamber in which is located a hollow conductor portion, so that an explosive charge can be introduced therein. The conductor portion can be connected through contacts with power lines. The explosive charge can be ignited with any ignition device, for example with a filament. The hollow conductor portion can thus be blown so that an insulating distance is thus created. The formation of a light arc should be suppressed by a bag or a container that is filled with water. The water is partially evaporated by the heat of the explosion and it should therefore support the deletion of the light arc. An important advantage of the explosive insulator is that a very fast disconnection of a circuit can be achieved. However, the deletion of the light arc with water does not appear to be satisfactory and it could also lead to wetting of the surrounding component parts. It should be further also noted that an interruption of the switching circuit can be caused here by the explosive charge. A manual operation is not possible, which means that this is not a switch in the classical meaning of the word. An encapsulation of the device, which would enable the effect externally, is not possible because the blast fumes, the debris from the explosion and in particular the evaporating water would create overpressures that could not be controlled anymore with normal means, but could only be controlled with extremely strong, metallic wall thicknesses.

The German Utility Model Publication DE 20 2007 013 841 U1 discloses an electrical switching device that is equipped with a crankcase. The operation of the switching device is carried out mechanically via this crankcase, for example so that it can be switched from an open position into a closed position, Insulating gas is employed in order to suppress possible occurrences of light arc. In order to reliably suppress a light arc, this insulating gas must have a predetermined minimum pressure. A pressure sensor is provided to ensure that a minimum pressure is maintained. When an insulating gas appears to suppress reliably occurrences of light arc, for example with something like a water bag, this makes it very complicated to provide pressure sensors. In this regards, therefore, a simpler solution would be desirable.

German Unexamined Patent Application DE 198 19 662 A1 discloses an electrical switch for interrupting the power supply of a motor vehicle. The electrical circuit corresponds substantially to the concept of a disconnecting switch.

It should in particular serve to avoid short-circuiting in the electrical system in a motor vehicle in case of an accident. A similar short-circuit can cause fire when there is leaking fuel. That is why the electrical switch is inserted after the battery terminal. The electrical switch may be triggered for example with a squib, which in its turn is triggered by a crash or a collision sensor. A spark can occur when the switch is disconnected. This is to be shielded by the housing against the environment.

This electrical switch is designed for high currents and voltages, which can occur with a short-circuit in a battery or comparable short-circuiting in a motor vehicle. However, the generation of a spark cannot be completely avoided, which is why the housing must protect with reliability against this.

German patent application publication DE 102 05 369 B4 discloses a similar switch in the form of an electrical fuse, in particular a pyrotechnic fuse for interrupting high currents in electrical circuits. Also this fuse is designed to be used in particular to disconnect on-board wiring of an auto battery shortly after an accident. But also this improved approach does not allow for any kind of manual switching.

Although both last-named switches are well compatible with source voltages under 100 V of rectified voltage, light arc would still necessarily occur, which would remain stable in the moment of disconnection with high electrical currents, so that the switch would be destroyed but the circuit would ultimately not be disconnected.

DESCRIPTION OF THE INVENTION

The objective of the present invention is to improve the prior art, in particular by providing a disconnecting switch, which is suitable for high DC and AC current at high source voltages, which can be readily used even without maintenance for many years, and above all, has no effect externally when its action is triggered, which is to say that it does not affect surrounding components. The switch should be safe and yet inexpensive to manufacture. It should be also possible to combine it easily with other safety systems.

These advantages are achieved by a switch according to claim 1.

The switch should be converted from a conducting position to a disconnecting position. The connecting position can be also described as a switched-on position. In this position, the current flows between a first contact and a second contact.

In the disconnecting position, no current flows at least between the first contact and the second contact. It is easily possible that current flows in this disconnecting position between two other contacts, for example between the first contact and a third contact. In such a case, the switch would not be only a disconnecting switch.

The switch should be suitable as a disconnecting switch for high currents at high source voltages. In any case, it should be suitable for voltages above 100 V and also for disconnecting direct currents. The switch is in its construction suitable for according to all regulations also for medium and high voltages in accordance with VDE regulations, in particular for voltages of more than 1 kV.

The switch is provided with a first contact and with a second contact. As was already mentioned, it could be also equipped with other contacts. It is to be connected, at least with the first contact and with the second contact, to a switchable electrical circuit, which is to say in an electrical circuit that is potentially to be disconnected. In the conducting position of the switch, the electrical connection between the first contact and the second contact is established with a connecting element. As a rule, the connecting element connects the first contact and the second contact also mechanically.

The connecting element extends in an expedient manner substantially along an axis. A suitable connecting element is therefore a connecting wire. The wire does not need to have in this case a uniform structure, it may well comprise also mechanical weaknesses and reinforcements. A more or less structured or perforated connecting plate is also suitable for this purpose. On the one hand, the connecting elements must be dimensioned with respect to its geometry and its material according to electrical requirement, which is to say for conducting current in the conducting position. The connecting element can consist for example of copper or its alloys, or tungsten or its alloys, in particular of a material that although it is highly electrically conductive, requires at the same time the highest possible energy for its evaporation and ionization, as is the case for example with tungsten and its alloys. Coatings of connecting elements made of such metals or alloys are also a possibility.

On the other hand, the connecting element should be also selected for its functions desired for switching. In particular, in accordance with the invention it should be possible to shift the connecting element into a position in which the first contact is electrically separated from the second contact, which is to say that the switch is in its disconnecting position. For this purpose, a switching piston should be provided that acts mechanically on the connecting element in such a way that the electric connection between the first and the second contact will be interrupted.

With such an interruption, at least one disconnecting position is as a rule formed. The disconnecting position extends in this case over a certain distance of the former path of the connecting wire. It can be also referred to as a separating distance. It is preferred when the separating distance has a length of more than 1%, or more than 5% of the former connecting wire, while values between 5% and 20% are as a rule also useful. It is also possible to create a plurality of disconnecting positions in the connecting wires. This can occur in the moment in which the switching is desired. Alternatively or additionally, formation of disconnecting positions with overloading is also possible as will be described in more detail later.

It is therefore expedient when the switching piston is mechanically connected with the connecting element. For example solder joints can be used for this purpose, while crimping is also equally suitable, as is the use of displacement contacts or multi-contacts. The switching piston and the connecting element can be ideally created with an integrated design to avoid unsafe connections.

Various mechanical movements can cause the transition of the switch into the disconnecting position. For example, the switching piston could cause torsional movement about the symmetrical axis of the connecting element and subsequent cracking of the connecting element with twisting. Alternatively or additionally, the switching piston can be destroyed with a pulling movement along the main axis of the main axis of extension of the connecting element. After the pulling movement, a first connecting element section, a separating distance and a second connecting element section are created. Such a pulling movement has already proven to be particularly advantageous. This is in particular due to the fact that a selectable separating distance is created differently with a pulling movement than with a torsional movement.

The translatory motion can disconnect the connecting element itself, but it can be also used (exclusively or additionally) to release the contact between the connecting element and the first or second connecting element. An insulating distance will be generated also in this case. It is therefore advantageous to continue this movement through the rupture point of the connecting element, which first generates an insulating distance and extends it when this movement is continued. In one movement can be generated a first separating distance, for example by a disconnection of the first or second contact, and a second separating distance is generated after that, for example by a disconnection of the connecting element.

The switch should be provided with a housing. This housing should guide the switching piston. The guiding of the housing also enables a movement of the switching piston relative to the housing, for example the pulling movement described above. During this movement, the housing should at least partially guide the piston. It is advantageous when the housing is provided with a hole, for example in the region of a cover. The switching piston, which is as a rule designed as a round cylindrical body, can be easily guided through such a hole. Alternatively or additionally, the piston can be connected with the housing via a folding bellows. A hole can then be omitted and a better and even more hermetically effective sealing of the housing from the exterior can be achieved.

The housing should be provided with an interior space. Relative to the housing, this interior space is a cavity. The interior space should surround the connecting element at least partially. The fact that a housing is provided alone results in protection against flying sparks when the connecting element is mechanically transferred into the disconnecting position and when there is a concern that with this separation of the connecting element, formation of a light arc could occur.

Within the context of the invention, however, the interior space of the housing should be additionally filled with an insulating medium. This insulating medium should be able to suppress completely the formation of a light arc, or at least to limit the formation with respect to its strength, path and duration. It should intercept joint fragments that can be eventually generated with the separation as a result of the current flow at the separating location and most importantly, to absorb the energy of the light arc, which is created here in this manner with reflows and cooling, and thus to extinguish the light arc.

The insulating medium may be a silicate, mineral or a special metal, in particular a material that has a high thermal conductivity with a small electrical conductivity, and a high melting energy at the lowest possible melting temperature. Quartz sand is in particular suitable with respect to the size of the housing. The use of other sands is also conceivable. As an alternative to a sand of mineral origin, a metallic sand is also a possibility. Such insulator media can be also mixed. Other potential insulating media include for example oils, for instance silicon oil, transformer oil, rapeseed oil, but also sunflower oil, such as its fats and gels. Distilled water is also an option. Further, a protective gas can be also introduced. Within the context of this invention, a high vacuum should also be considered an insulating medium.

Various forms may be suitable for the switching piston. A cylindrical shape is often selected because this design can be manufactured particularly cost-effectively. A shape with a non-round cross-section could be also selected, for example a shape with an elliptical or rectangular cross-section. It is useful when the switching piston is provided with an annular projection on the side facing away from the connecting element. It is also expedient within the context of this invention when the switching piston can be (at least additionally) also moved manually. The movement is particularly successful when a gripping region or a gripping ring is provided. As a rule, the movement will in this case be a pulling movement, so that the switching piston is thus pulled out from the housing. Drives that are also known as pin-puller drives, are a means that can move the switching piston in this manner. The switching piston can in this case be a constituent of the driver, or it can be impacted (pulled) by a movable piston of the drive. The switching piston could be alternatively or additionally also equipped with an eyelet in addition to the gripping ring, or with a ring or the like.

The switching piston should be as a rule electrically conductive. For this purpose, it may be advantageous when it is made of metal, for example copper or its alloys, or from tungsten and its alloys. It can also consist of the same material as the connecting element and it can also be again only coated with these materials.

Alternatively or additionally to the manual movement of the moving piston, other forms of movement are also possible. In particular, the switching piston can be moved by means of a controllable drive. The drive can be for example designed as an inductive drive. An inductive coil can be deployed for this purpose at a suitable distance. The switching piston can be designed also magnetically in a suitable way. However the switching piston can be also equipped with its own induction coil. It would be also conceivable to equip the switching piston with an induction coil and provide a suitable distance with an induction coil to a reference point, for example a permanent magnet. In this manner, the switching piston can be also moved, additionally or alternatively.

A drive using an eddy current is also conceivable. In this case, a force coil is located between the housing with the connecting element and the end plate of the switching piston, through which a surge current flows to induce the desired switching state. A current is thus induced in the end plate, which is located in front of the force coil and made of a material that has good electrical conductivity, which in accordance with Lenz's law is located in the force coil opposite to the excitation current, so that the end plate of the switching piston is extremely quickly pushed away from the force coil and with a high force and the connecting element that is connected in the housing is ruptured.

It may also be appropriate when gas pressure is provided for the movement of the switching piston. In this case it is advantageous when the switching piston is equipped with a sabot. The gas pressure can act on the sabot and move in this manner the switching piston in the desired direction, which as a rule means out of the housing. Such a gas pressure can be built up with suitable gas lines. In order to achieve a quick disconnection, it is particularly advantageous when the relevant gas pressure is built up pyrotechnically. For this purpose, it is advantageous when a propellant powder is provided in a suitable position of the combustion chamber, which can be activated by means of an ignition device or an igniter.

A gas pressure can also be built up with suitable gas lines. For this purpose, the diameter of the end plate of the switching piston is increased in such a way that it abuts the inner walls of the piston housing. In addition, it should be as a rule sealed so that it is gas-tight. A closed room can be thus created in this manner, which can be filled via a gas line with a gaseous medium or with a propellant gas. Many technical gases are suitable for this purpose, for example air, nitrogen and carbon dioxide. Carbon dioxide has in particular the advantage that it can be stored in the form of dry ice. It can therefore be used at a predetermined point in time to trigger the switch. An autonomous energy switch can thus be provided in this manner. In addition, it is also conceivable to apply heating to the stored carbon dioxide so that the gas could be generated even faster. The gas pressure can be generated also with decomposition of a liquid or solid substance, for example dry ice.

Also liquid and gaseous fuels and oxidizers can be injected into the combustion chamber, when the switch is integrated or connected with to it. Such fuels and oxidizers will be hereinafter referred to as gas-generating materials. Pyrotechnic gas-generating materials should be also included in this manner, regardless of whether they have a deflagrating or detonative conversion. After the activation of the combustion or oxidation process, these gas-generating materials produce a pressure (or a significantly higher gas pressure when compared to the initial state with gas-generating fuels and/or oxidizers), which impacts the switching piston and moves it from the connecting position to the disconnecting position. A spark plug, a filament or an igniter can be used for ignition. Alternatively or additionally, the combustion chamber may already contain either fuel or oxidants (in liquid solid or in gaseous form). It is then possible to add the other substance at a point in time selected for activation of the material required for igniting and/or for generating gas.

Such a system, as well as a complete pyrotechnic system, makes it possible to achieve a fast and reliable disconnection of a circuit even after many years, while the system requires little maintenance, and in some cases no maintenance at all for many years.

In order to ensure pyrotechnic generation of gas pressure and thus also the pyrotechnic triggering of the switch, a pyrotechnic mixture must be introduced into the combustion chamber. At the desired time, this mixture can be then ignited with a spark or with an ignition means.

Alternatively or additionally, the combustion chamber can be also equipped with an ignition device or an ignition piece. With a suitably selected ignition device or ignition piece, sufficient gas and/or exhaust products can be generated so that a sufficient pressure can be built up in the combustion chamber. This can be done via an end plate, which works as a sabot moving the switching piston by a sufficient amount to generate a separating distance. When the pyrotechnic triggering of the switch via a combustion chamber is provided, the effect of the combustion chamber can be increased when the combustion chamber is filled with a filling body. Such filling body can reduce the unnecessary empty volume in the combustion chamber, so that already a much smaller gas amount is required to bring about the pressure that will be required to move the sabot and thus also the switching piston. It should be also recognized that the pressure must be at the highest level at the beginning of the combustion process because the rupturing of the connecting element (or the outward movement of the connecting element from a socket in alternative embodiments) is to be introduced thereafter.

Alternatively or in addition, filling of the combustion chamber with water, mineral or natural oils, but also with silicon oil (in each case without a swelling agent) can be also taken into consideration. Water in this case serves not only as a filling body, since the high pressure created by generated steam also makes it possible for the water to have the effect of a propelling means. With skillful use of the boiling process, a very large and a quickly increasing pressure effect on the end plate can be created in this manner with a very small hot gas effect, for example with an ignition device or ignition piece.

Particularly the combination of an ignition piece with such liquid filling bodies, in particular water or oil, is so efficient that a good technical coupling, or a coupling of a shock wave with the end plate can be achieved.

In another embodiment of the switch, the switching piston can be connected also with a membrane that replaces the end plate. The membrane can be deformed in the direction of the movement of the switching piston during the disconnection. A membrane generally has a smaller mass than an end plate, which facilitates faster movement. Bursting of the membrane can be prevented by using appropriate means, for example a protective disk, referred to here as a membrane protecting ring. A membrane has in particular the advantage that it is well sealed from the exterior, which is why no sealing problems occur for a long time. Such a membrane can be also employed by combining it with a bellows.

Under high mechanical stresses on the membrane, and also due to safety considerations, several individual membranes can be used or inserted so that they are superimposed on each other. For example two membranes superimposed on each other have half the strength of a membrane with the same thickness and they can be deformed easier than a thick membrane with the same total mass, while in addition, this also serves to make sure that an eventual rupture present in one of membranes will not be harmful and that the propelling gas will still remain securely enclosed in the combustion chamber.

However, mostly just one membrane is mentioned here to simplify the explanation.

The connecting element can also have different forms. It is expedient when the connecting element is a small tube. Alternatively, the connecting element may also be a wire.

A belt or band shape would be also appropriate, and this shape is particular suitable for creating holes in it and embossing it for predetermined separating position. The connecting element can be also produced in a suitable manner from a metal, from copper, brass, gunmetal, steel or stainless steel. Alloys of these materials can be also considered for use, as well as electrically conductive coated carbon fibers and glass fibers.

In order to achieve a light and predefined mechanical separation from the connecting element, the connecting element can be weakened in one or several locations. Fine bores or scratch lines can be provided for this purpose.

The connecting element can be also designed in such a way that it is separated not only with a mechanical effect, but also with an electric load. In other words, the connecting element can also function as a fuse, so that it essentially acts as a safety fuse. This is a particularly remarkable aspect of this invention. The invention is provided not only as a mechanically separable disconnector that is suitable for disconnecting high currents with high voltages, but at the same time also as a fuse for protection from overloading. In accordance with the concept of this invention, these two separate functions are per se not contradictory. For example, said mechanical weakening locations of the connecting elements can be as a rule designed as cross-sectional narrow parts, so that the current density is increased in these cross-sectional narrow parts. Therefore, the connecting element is heated particularly strongly here and the melting point of the material will thus be reached first in this location.

When several electrically effective weakened locations are provided one after another in a connecting element, this also makes it possible to ensure that in the case of overloading or of a desired failure, the material of the connecting element will be separated in several locations. Therefore, this makes it possible to ensure that the entire switching voltage is no longer applied at each separating location, so that the ionization of the material of the conductor pierce is drastically decreased and the extinguishing of the generated light arc is thus also simplified.

In another preferred embodiment of the invention, the connecting element itself is also a pyro element, for example a Pyroseele element. Such a Pyroseele is strongly heated up at the intended locations due to a large current density, so that a particularly rapid safety disconnection of a circuit can be created in this manner. The insulating medium suppresses a potential occurrence of a light arc due to electrical overloading even with this kind of disconnection.

Instead of a Pyroseele, a tubular connecting element may be filled again inside with an insulating medium so as to additionally remove a light arch that could be potentially generated during the disconnection of the connecting element.

Other functional embodiments of the connecting element are of course also possible, which bring significant benefits within the context of the switch according to this invention. For example, the connecting element can be provided with at least one electrically weakened cross-section to ensure disconnection of the connecting element as a result of an overload current. It is also possible to provide the connecting element with at least one mechanically weakened cross-section geometrically determining the separating locations. In both cases, a plurality of such weakening cross-sections can be also provided, one behind another. These weakened cross-sections can be also spaced in such a way that several predetermined short separating points or separating paths are created in this manner. Suitable mechanical weakening points are for example bores, recesses, cutouts, constrictions, etc. The connecting element can be equipped with such elements during the production of the element, or thereafter.

It is frequently advantageous when such weakened cross-sections are created in the longitudinal direction of the connecting element with constant or variable spacing. This is because the formation of a plurality of separating distances with a desired overload leads to lower switching voltages compared to the external voltages applied between the contacts of the source voltage applied to the switch. With a series of switches provided with resistance, only one part of the applied external voltage will be decreased per the separating distance.

In order to determine the disconnecting conduct in advance with better precision, soldering, stamping or welding can be also considered. Heat sinks can be produced in this manner, which also have an influence on the separating behavior (in particular by suppressing the separation in such locations).

Another significant improvement of the effectiveness of the connecting element, additionally or alternatively to solutions that were already mentioned, are based on placing pyrotechnic material on the connecting element in one or in several locations. Separation can thus be achieved in this manner even with a relatively small overload, since the ignition temperature of the selected pyrotechnic material will be reached already and a separating distance will be created with ignition. Alternatively or additionally, a separating distance can be created faster or it can be increased, or regression or decreasing of the separating distance can be prevented.

A pyrotechnic material may in this case be used which is not (only) sensitive to heat, but also sensitive to friction. Ignition can be initiated with the mechanical movement of the piston or of an external pin-puller drive. As was already mentioned, the switching piston can be a constituent of a pin-puller drive, or a movable piston of the pin-puller drive can be connected with the switching piston.

Alternatively or additionally to these devices, numerous improvements can be also provided, mostly outside of the actual housing of the switch. The switching piston can be for example also moved by a pyrotechnical means that is deployed outside of the housing, in particular by a pyrotechnic pin-puller drive, or by a pin-puller drive which is operated based on gas pressure that is not generated pyrotechnically. The devices for the gas or pyrotechnic drive can be in this case located in the interior of the housing of the switch (which is to say that the drive is designed so that it is integrated with the switch housing, or that the drive housing is located inside the switch housing), or outside of the switch housing. In the latter case, the drive housing can be directly connected with the switch housing so that it is adjacent to it, or it can even be located at a distance outside of the switch housing, wherein the movement of an drive element is mechanically transmitted to the switching piston (for example by an additional connecting piston, or by a switching piston designed with a corresponding length, or by a pin-puller drive of the piston).

In principle it is also advantageous when two switching pistons or a corresponding two pin-puller drives are provided on one switch. This enables triggering the switch in two locations, for example on both sides. Alternative triggering, or even double triggering (simultaneous triggering) can be carried out in this manner. In any case, the construction is designed with a redundancy, which results in an even more reliable disconnection of the circuit.

In principal, the switch can be also equipped with components that improve its electromagnetic compatibility (EMC) and/or its susceptibility to electrostatic discharge (ESD). Corresponding protective components such as ferrite rings, Zener diode, suppressor diode, coils or varistors, in particular SIOV varistors, can be provided on the switch and/or on the drive. They can be provided with or without a connection to other electronic components of the switch.

Further features as well as advantages of the invention will become apparent from the following drawings and the accompanying descriptions. In the figures and in the descriptions belonging to the drawings are described the combinations of the features of the invention. However, these features can be also included in other combinations according to the object of this invention. Each disclosed feature is therefore to be considered also as a technically advantageous combination in combination with other features. The figures are partially slightly simplified and schematic. The following figures show in each case the same switch in its conductive position (in each case in Fig. a), as well as in its disconnecting position (in each case in Fig. b).

Figure 1A:
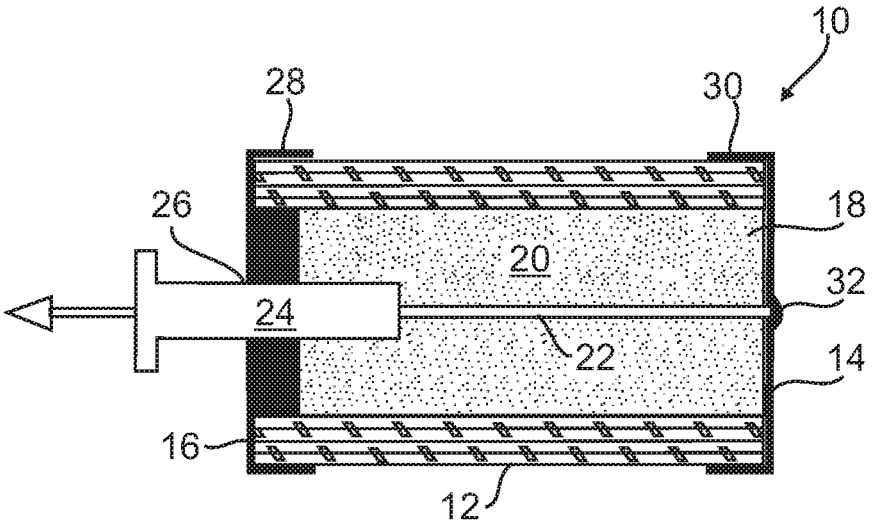
FIG. 1 shows a first embodiment of the invention in a cross-sectional view, wherein a crack or a separation point t is generated in the connecting element.
Figure 1B:
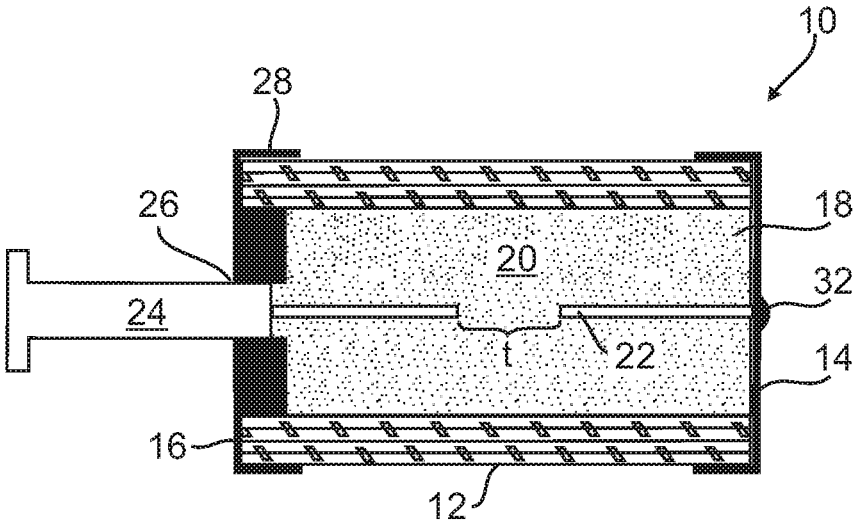

FIG. 1 and FIG. 1*b* show a first embodiment of a switch 10 according to the invention. This switch 10 is provided with a housing 12, which is designed essentially with a cylindrical shape. The housing 12 is provided with a housing base 14 and with a housing cover 16. These components delimit the interior 18. The housing interior 18 is filled with insulating medium 20. As shown in the figures, this can be in this case granular insulating medium 20, for example quartz sand. The connecting element 22 extends in the interior space 18. The connecting element 22 is mechanically connected with the switching piston 24. The switching piston 24 is guided by a switching piston guide, which is provided in the form of a bore in the housing cover 16.

A contact 28 is provided on the outer side of the housing 12 in the vicinity of the housing cover 16. This contact can be manufactured in an integral form with the cover 16 and it is in any case connected with the housing cover 16 so that it is electrically conductive. The housing cover 16 is in its turn connected so that it is electrically conductive in the region of the switching piston 24, which is again connected in an electrically conductive manner with the connecting element 22. The connecting element 22 is connected mechanically and also in an electrically conductive manner with the housing base 14. The housing base 14 is in its turn also designed integrally with the second contact 30. Accordingly, the housing base 14 is also connected in an electrically conductive manner with the second contact 30, so that the second contact 30, which is formed with an annular design around the housing 12, can electrically contact the switch 10.

FIG. 1*b* shows the switch 10 in the disconnecting position. The connecting element 22 is separated by pulling on the switching piston 24 in the direction indicated by an arrow in FIG. 1*a*. It is therefore then provided with a first section and with a second section. Because a separating distance t is located between them, no current can flow. The formation of a light arc is suppressed by the insulating medium 20, which penetrates also into the region of the separating distance t.

Figure 2A:
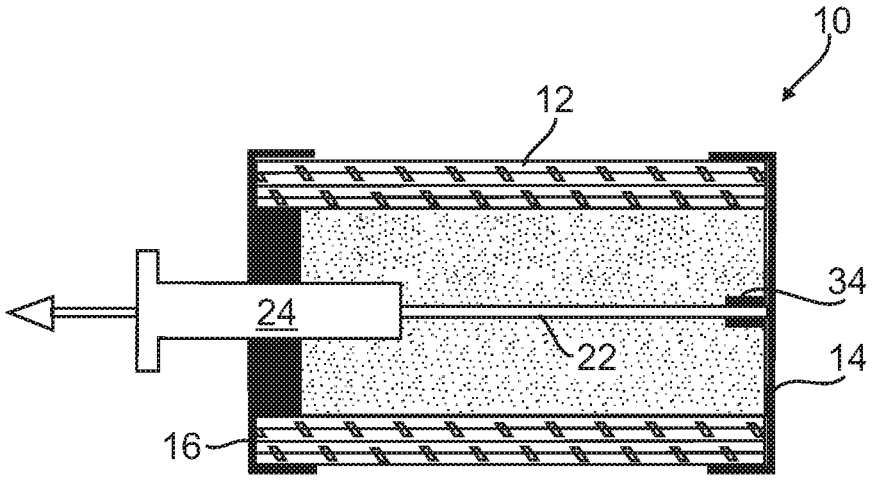
FIG. 2 shows a corresponding view of another embodiment, in which the connecting element is pulled out from the first contact and therefore separated from it.
Figure 2B:
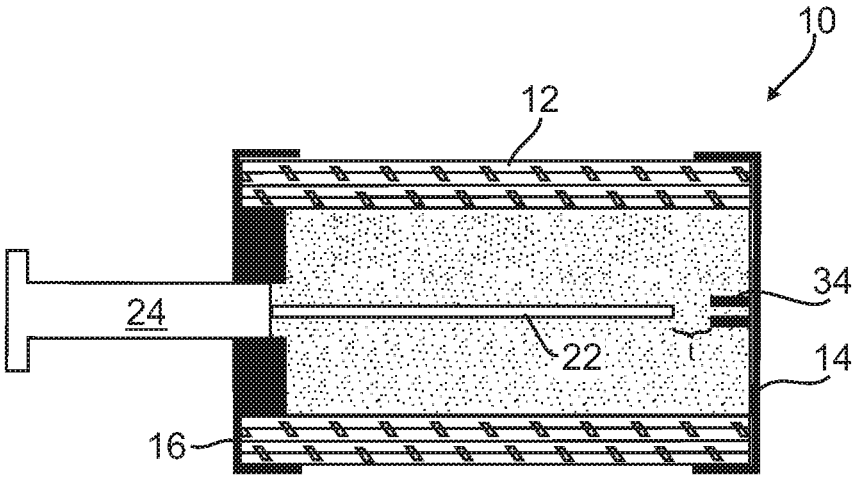

FIG. 2*a* and FIG. 2*b* show another embodiment of a switch 10 according to the invention, again both in the conducting position (FIG. 1*a*), and in the disconnecting position (FIG. 2*b*). The basic construction of the switch 10 corresponds to the construction illustrated in FIG. 1*b*. Therefore, only some essential elements of the switch 10 are shown in the figure, which are again indicated by reference symbols. The switch 10 is again provided in a housing 12, which extends between the housing base 14 and the housing cover 16. A connecting element 22 is again provided, which is mechanically connected with the switching piston 24. However, unlike in the embodiment form of FIG. 1, no anchor point 32 is provided on the housing base 14; a receptacle 34 is provided instead. The socket-like receptacle 34, which can be also designed as a multi-contact socket, receives in the conducting position the facing the end of the connecting element 22 facing the socket.

The arrow shown at the switching piston 24 in FIG. 2*a* indicates again the pulling direction, in which the switching piston can be pulled from the switch 10, so that the switch piston 24 passes into its disconnecting position. In this case, the connecting element 22 is not ruptured; instead, the connecting element is pulled out from the first receptacle 34. Accordingly, a separating distance t is created between the right end of the connecting element and the receptacle 34.

Within the context of the present invention, however, other embodiment forms are also conceivable, in which two or more separating distances are created. For example, additionally to the separation of the connecting element from the receptacle 24, another one or a plurality of cracks could be created in the connecting element. The connecting element can be for this purpose provided with weakened regions.

Figure 3A:
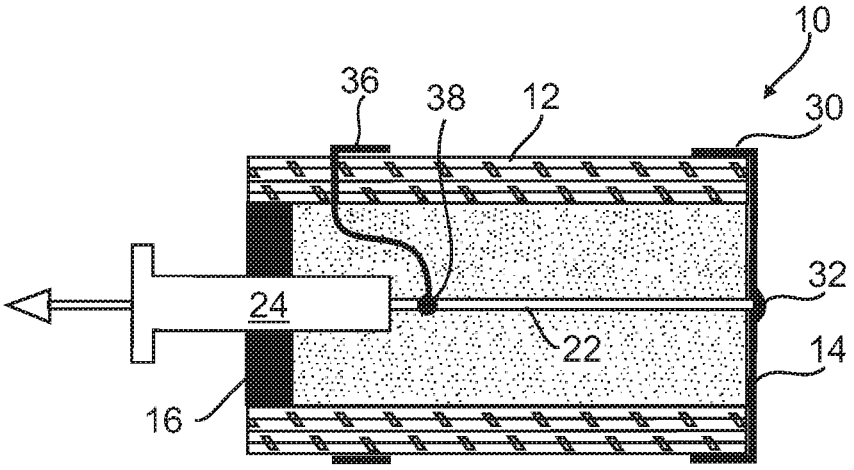
FIG. 3 shows an embodiment corresponding to FIG. 1, in which, however, another housing and other contact points are provided.
Figure 3B:
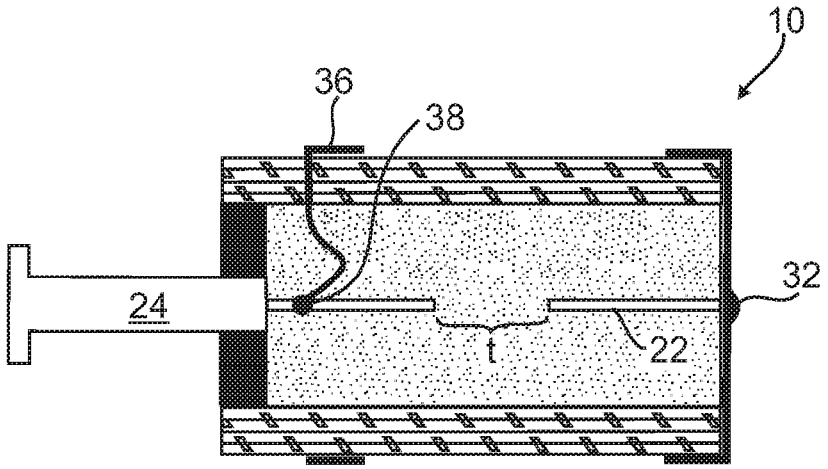

FIGS. 3*a* and 3*b* show another embodiment of the switch 10, which is similar to the embodiment of FIG. 1, but in which the first contact is provided in another manner. A housing base 14 is again provided on the lower side of the housing 12 of the switch 10 and a housing cover 16 is provided on the on the upper side of the housing 12. However, the cover 16 is in this embodiment provided fully enclosed in the housing 12 and it covers the front side of the walls and does not cover the sides of what can be considered a cylindrical shape. Another contacting type is created with this mechanical solution. The first contact is here provided with the contact point 36 on the housing 12, which is located slightly below the housing cover 16. The contact point 36 is again to be thought of as a circumferential ring. The contact point 36 is connected with the connecting element 22 through a contact wire 38. The connection between the contact wire 38 and the connecting element 22 can be created for example via a solder joint. The connection of the contact wire 38 with the contact point 36 can be created with an integral design or through a connecting process, such as for example via a solder joint. As shown in FIG. 3*b*, the connecting element is ruptured when the switching piston 24 is being pulled out in the same manner as in the embodiment of FIG. 1.

It goes without saying that also the second contact can be replaced by a radial outer contact, so that the front side would no longer be fully electrically conductive on the entire surface—and in the case of a connecting element that is insulated inside the at the housing base 14, the connecting element 22 would no longer be fully insulated (not shown here).

Figure 4A:
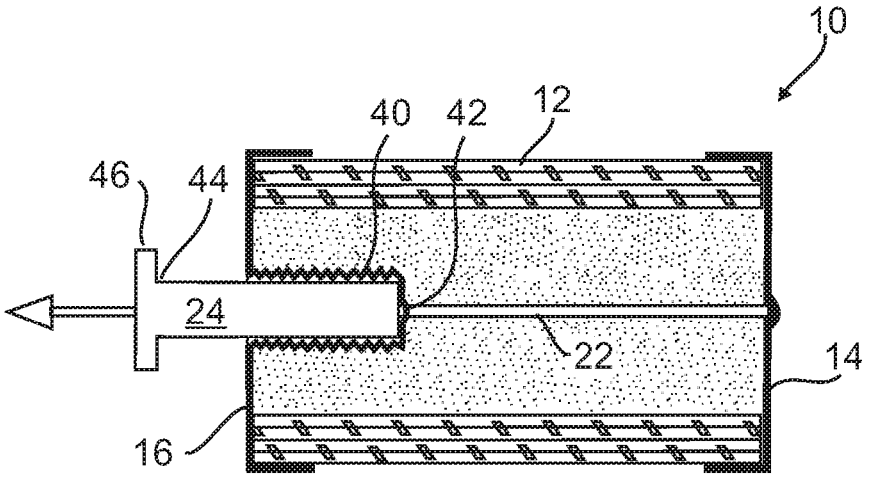
FIG. 4 shows another embodiment of the invention, in which the housing is provided with a folded bellows.
Figure 4B:
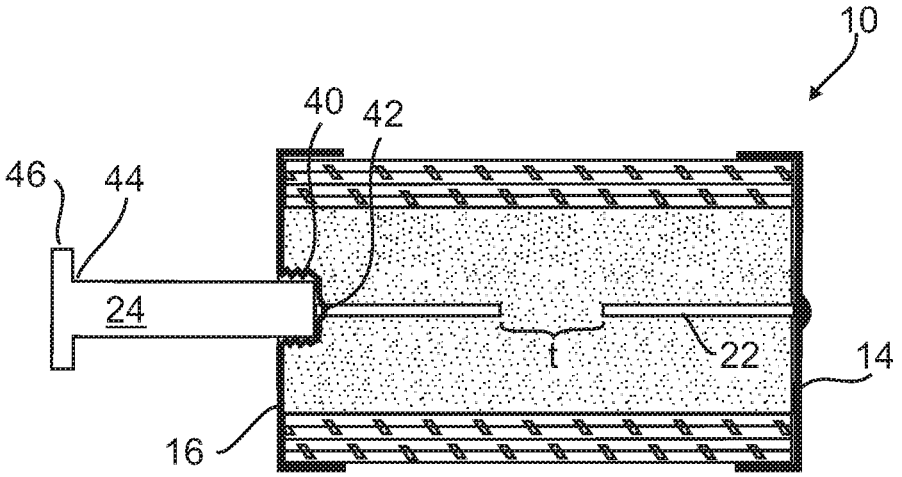

FIGS. 4*a* and 4*b* show another embodiment of the switch 10. In this embodiment of the switch 10, a cylindrical housing 12 is provided with a cylindrical housing 12 having a housing base 14. A connecting element 22 passes again through the housing 12. However, the housing cover 16 is in this embodiment provided with a folding bellows 40. The folding bellows 40 separates the switching piston 24 from the interior space of the housing 12. An electrical through-feed is provided only for an electric connection of the switching piston 24 with the connection element 22.

With the movement of the operating piston 24 in the direction indicated with an arrow in FIG. 4*a*, the switch 10 is transferred to the disconnecting position shown in FIG. 4*b*. A crack or a separating location t is again created with the movement in the connecting element 22. The folding bellows 40 will be in this case pushed to the left so that it will be then in its relaxed position.

Therefore, the implementation of the switching piston with the housing cover 16 can be omitted in this embodiment. The internal space of the housing 12 is well sealed externally and in addition, the switching member can be made of an insulator and the electrical disconnection of the safety part/housing with the triggering part can thus be realized in a safer and cleaner manner. This housing variant is also particularly suitable for liquid or gaseous insulation media 20. It is suitable even when a vacuum or a high vacuum is to be created for electrical insulation in the interior space of the housing 12. In the illustration of the example of this embodiment, it is shown that the switching piston 24 is provided in the region facing away from the housing 12 with a handle portion 44. This handle portion 44 can be provided with a gripping ring 46, which is particularly useful for manual operations of the switching piston 24.

Figure 5A:
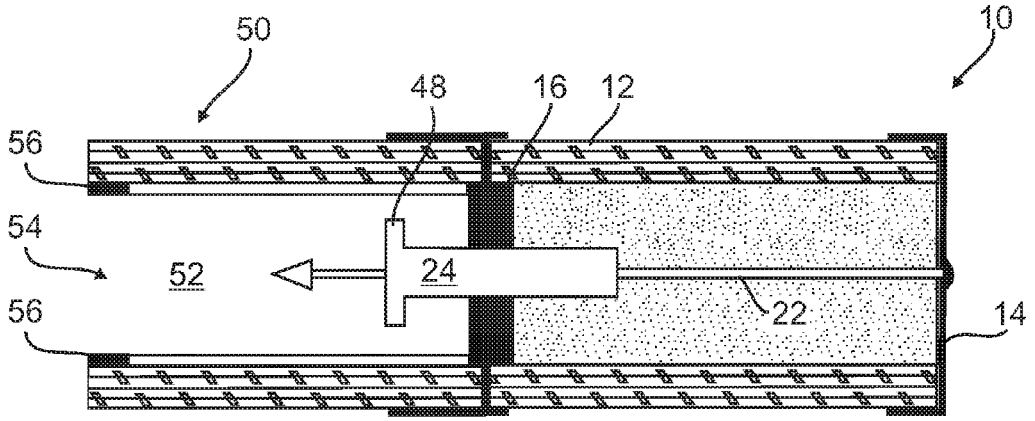
FIG. 5 shows another embodiment of the invention, in which an additional piston housing is provided, wherein the switching piston itself is located inside the housing.
Figure 5B:
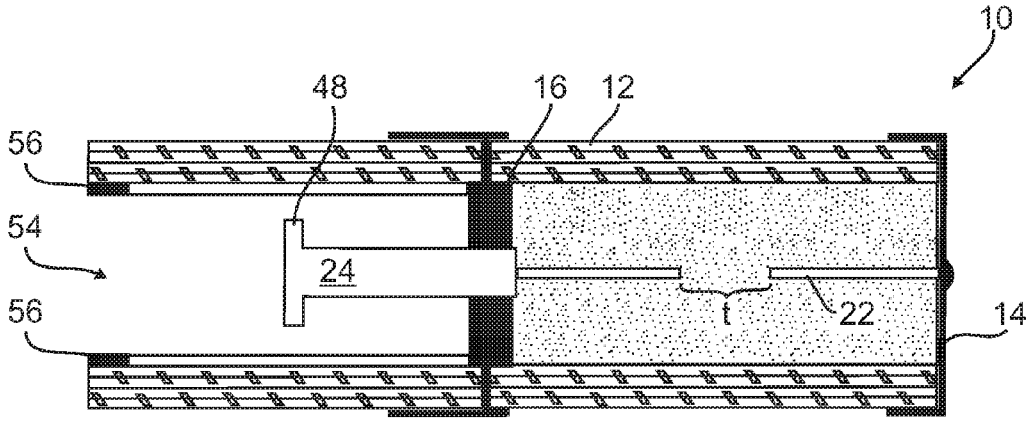

FIG. 5*a* and FIG. 5*b* show an embodiment that is not optimized primarily for manual operation of the switching piston 24. In this embodiment is in addition to the housing 12 of the switch 10 also provided an additional piston housing 50. The housing 50 can be also designed integrally with the housing 12. In the embodiment shown in the figure, the piston housing 50 is formed with a separate component, essentially with a cylindrical piece that is provided with the same diameter as the cylinder of the housing 12. As indicated, the cylinder of the piston housing 50 is connected by a plug connection with the housing 12. Accordingly, the housing cover 16 is designed such that it can accommodate both cylinders.

The switch 10 is equipped in a known manner with a housing base 14 which is again connected with the connecting element 22. The connecting element 22 is connected on the other side with the switching piston 24. The switching piston 24 is equipped with an end plate 48.

Although this end plate 48 can be designed identically or similarly to the gripping ring 46, its function is different from that of the gripping ring 46 as will be described below.

The piston housing 50 is provided with a cavity 52. This cavity is on the left side delimited by a front surface 54. The front surface 54 can be open, (which also permits manual operation of the switching piston 54), or it can be provided with its own cover 16. The induction coil 56 may have an effect at least on the end plate 48 of the switching piston 24. For this purpose, the end plate 48 should be made of a suitable material, for example a ferromagnetic material such as soft iron or steel is suitable for this purpose. With the inductive effect of the induction coil 56 exerted on the switching piston 24, which is advantageously transferred through the end plate 48, the switching piston 24 can be withdrawn from the housing 12 of the switch 10.

In this manner, the switch 10 is transferred into its disconnecting position, which can be seen in FIG. 5*b*. The connecting element 22 is again separated into a first section and into a second section so that a separating distance t is located between them. The switching piston 24 protrudes in this case further into the cavity 52 of the piston housing 50. The fact that the cavity 52 is provided ensures that for example other component parts will not impede the movement of the switching piston 24.

It is also easy to create the construction of a piston housing 50 in which an inductive movement of the switching piston 24 is not provided and the switching piston 24 is instead moved by gas pressure. In this case, the diameter of the end plate 48 of the switching piston 24 is increased up to the housing wall and sealed therein, so that a sealed space is then created between the end plate 48 and the housing cover 16, which is already sealed and which can be compressed with a gaseous media. When the gas pressure is increased here, the switching piston 24 will be driven out from the housing 12 of the switch 10. A corresponding gas pressure can in this case be easily built up with a pyrotechnic means, which will then turn the sealed space described above into a combustion chamber.

The ignition or activation of the pyrotechnic substance accommodated in the sealed space is then generally carried out with a hot wire, with an explosion wire, with an explosion foil or in a standard manner by a spark or ignition device. Several variants can be used within the context of the present invention.

Figure 6A:
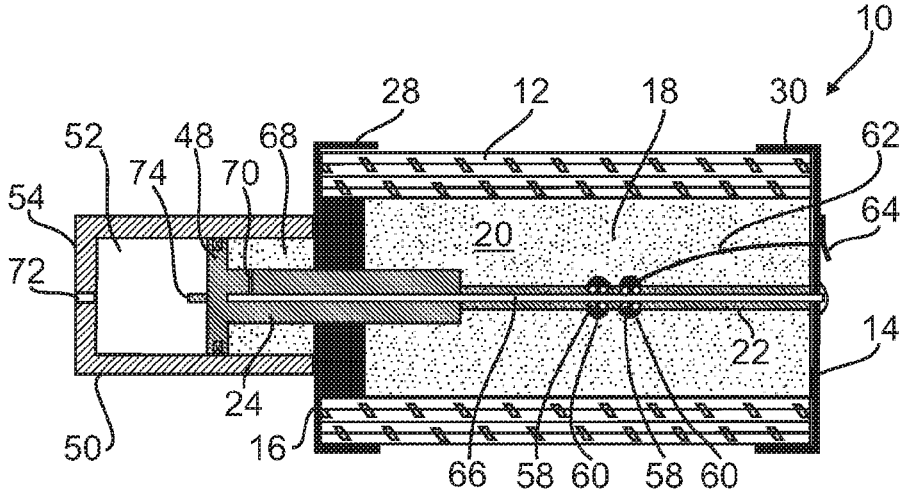
FIG. 6 shows another embodiment of the invention, in which a Pyroseele is employed, as well as a connecting element that is provided with a plurality of separation points, which are in this case additionally weakened with bores and provided with external pyro elements.
Figure 6B:
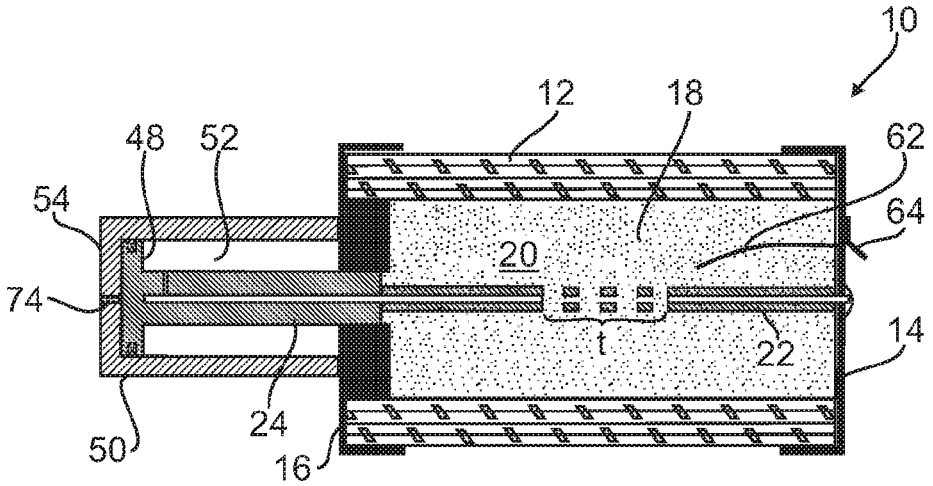

FIG. 6 shows another embodiment of the switch 10 in the known view. This embodiment is again provided with a housing 12 having a housing base 14 and a housing cover 16. The interior space 18 of the housing 12 is again filled with insulating medium 20. The insulating medium 20 is arranged in the connecting element 22, which is connected with the switching piston 24. However, the design of the connecting element 22 differs from that of the previous embodiments. The connecting element 22 is here designed as a melting tube. However, its shape does not necessarily need to be round, so that the designation melting tape is also adequate in other embodiments. In two regions of the connecting element 22 are provided a number of bores 58. These bores 58 lead to a cross-sectional narrowing of the current line between the contacts 28 and 30. Due to this cross-sectional narrowing, the current density is greatly increased in particular in these regions. The connected element 22 is thus heated up particularly strongly in these locations, so that the melting point of the material can be reached particularly rapidly in these locations. Alternatively or additionally, the heating can be employed not only to reach the melting point, but also to reach the ignition temperature of the pyro element. Pyro elements 60 are therefore mounted in the region of the bores 58. An explosion is thus triggered with the heating, which is particularly advantageous for the formation of a separating distance.

The region in which such a weakening is provided via the bores 58 and with the optional additional pyro elements 60 is connected with a sensor wire 62 with a status indicator 64. In the conductive position shown in FIG. 6*a*, the sensor wire 62 is under a voltage. This voltage is transferred by the wire to the status indicator 64, which is designed in the form of a simple leaf spring. In the separated position shown in FIG. 6*b*, the sensor wire 62 is separated from the connecting element 22. Accordingly, no voltage is being transferred by it anymore and the leaf spring is clearly visible outside of the housing 12. The leaf spring also serves as a status indicator. This status indicator can be also used to verify the functionality of the switch 10. It goes without saying that the concept of the status indicator with a sensor wire 62 can be also used in other embodiments of the invention.

This embodiment provides for yet another improvement of the effectiveness of the switch 10, which, however, can be also applied to switches according to other embodiments and in particular to other connecting elements. The connecting element 22, which has substantially the form of a melting tube, is in the cavity in its interior equipped with a Pyroseele, which is to say that the cavity is filled with an explosive substance. This explosive substance can also be brought to an explosion by heating the region of the bores 58. The pyro element 60 can at the same time have a supporting role, although this is not required. The fact that a Pyroseele is provided enhances the formation of the insulating distance.

For an even more rapid formation of a separating distance and thus also for an even faster contact disconnection it is advantageous when the Pyroseele shown in the embodiment illustrated here is additionally employed also for another purpose. The Pyroseele 60 continues in the piston 24 and functions as a type of a ignition transfer line. A channel-like ignition connection is even provided for this purpose in the piston 24. A pyro filling 60 can thus be ignited with this ignition connection. This pyro filling is located in a part of the cavity in the combustion chamber 68, which is again provided in the piston housing 50.

In this embodiment, the switch 10 is provided with an additional feature that can thus also be combined with other switches. The switch 10 is again provided with a piston housing 50. This housing encloses a cavity 52. The front surface of the piston 54 is in this case designed as a front wall. The end plate 48 is mechanically movable in the piston housing 50 (as long as the switching piston 24 is not fixed with the connecting element 22).

This configuration of the switch 10 still makes it possible to use an additional means for the acceleration of electrical disconnection and formation of a separating distance. This additional means can be also combined with switches in other embodiments. In the cavity 52 is between the end plate 48 and the housing cover 16 inserted in the combustion chamber 68 a pyro filling. During an explosion, this pyro filling will move the end plate 48 to the left and onto the front wall 64 of the piston housing.

The explosion of the pyro filling 60 can be in this case triggered as follows: the explosive substance of the Pyroseele 66 is connected through a channel which functions as an ignition connection 70 with the pyro filling 60. As soon as the explosion triggers the Pyroseele 66 in the described manner, the Pyroseele 66 functions as a pyrotechnic ignition transmission line that causes an ignition of the pyro filling 60. This ignition will obviously cause a movement of the end plate 48 toward and onto the front surface 54. In order to enable the corresponding gas compensation, a wall opening 72 is provided in the front surface 54. This opening can also accept the pin 74 of the end plate 48 and the triggering of the switch is thus enabled, resulting in the releasing of the switch, so that this can be also indicated purely optically to the exterior.

FIG. 6 also shows that with several weakening locations of the connecting element, created one after another after the triggering of the switch, several electrically disconnecting locations are formed in series. In this manner, high electrical voltage applied to the contacts or to the housing base in the moment of the triggering of the switch is distributed accordingly, so that only a correspondingly smaller portion of the original switching voltage or source voltage will be decreased at each disconnecting location. The potential for creating a light arc is thus very strongly decreased, so that the individual light arcs created in this manner are substantially more quickly and effectively cooled by the insulating medium or extinguished.

The embodiment of the switch 10 shown in FIG. 6 thus causes a very rapid formation of a separating distance t with three pyrotechnic effects and one electrical effect. The four described effects can be also used individually and independently of each other.

Figure 7A:
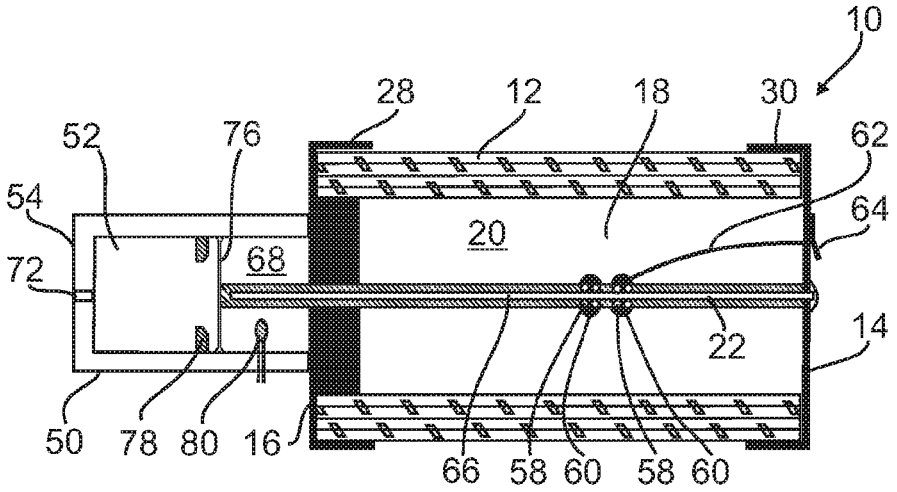
FIG. 7 shows another embodiment of the invention, in which the drive for tearing open the connecting element occurs through the movement of a membrane, which is thus depressed and deformed with the triggering of an ignition element in the combustion chamber.
Figure 7B:
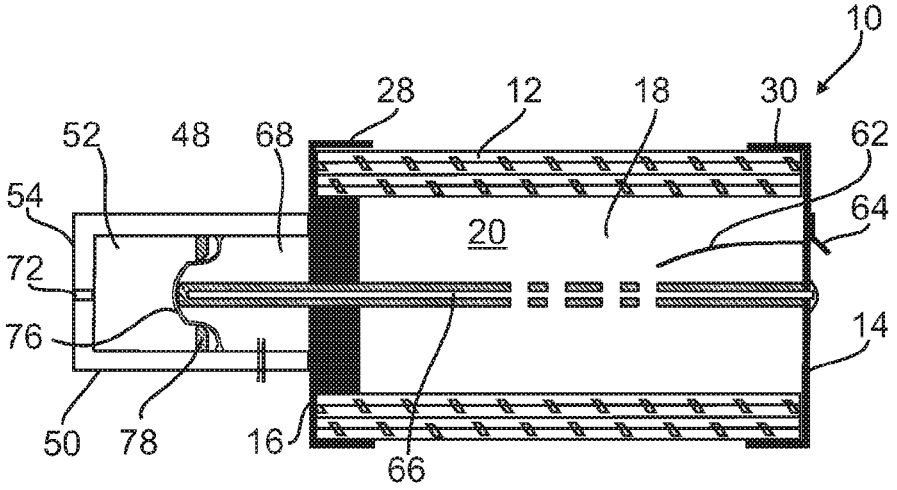

FIG. 7 shows another embodiment of a switch according to the present invention. The known view is selected again, so that FIG. 7A shows the switch in its conducting position, while FIG. 7B shows the switch in its disconnecting position. The basic components correspond completely to those of FIG. 6. A connecting element 22 is again accommodated in a housing 12. The connecting element 22 is again provided with bores 58 and with a pyro element 60 in the vicinity of the bores 58. However, unlike for example in the embodiment of FIG. 6, a switching piston 24 is not provided here and accordingly, there is also no end plate 48. Instead, the connecting element 22 is introduced inside through an opening into the housing cover 16. It is connected with a membrane 76, which can be also configured as a double membrane or a multi-layered membrane. This membrane 76 is fixed in a housing 50. The housing 50 is again provided with a cavity 52 and with a front wall 54.

With the aid of, for example, a suitable pyrotechnic means, such as the pyro element 60 and of the Pyroseele 66 that is provided here again, ignition can be initiated again, which leads to the disconnection of the connecting element 22. This is illustrated in FIG. 7*b*. With a corresponding positioning and dimensioning of the pyrotechnic element, a movement of the parts of the connecting element 22 to the left can be caused in this case, which is to say onto the housing 50. This leads to a bulging of the membrane 76. It is advantageous that the actual weight of a membrane is very low and the movement of the parts of the connecting element into the housing is thus opposed only very little by inertial mass.

Very fast movement of the membrane 76 onto the front wall 54 can thus be caused in this manner. In order to avoid damages on the membrane 76 itself, it is practical when a membrane support ring 78 is provided.

In order to enable a rapid movement of the membrane 76, another wall opening 72 can be again provided, as shown, so that no counter-pressure will be created with the compressing of the gas (air) which is present ahead of time in the cavity 52.

This movement is alternatively or additionally, although as a rule additionally, triggered or strengthened by an ignition element 80. The ignition element can be for example an ignition unit or an igniter. The ignition element 80 is located in this case in the combustion chamber 68 of the housing 50. The combustion chamber 58 can be filled with a propellant charge powder to enhance the effect on the membrane 76. Alternatively or additionally, a filler consisting of a solid, liquid or gel-like material can be also used. Such a filler both reduces the free volume in the combustion chamber and makes it possible to reach higher pressures already with very low amounts of pyrotechnic materials, while on the other hands it also couples in an optimal manner the pressure wave generated during the combustion or conversion of the pyrotechnic material with as little attenuation on the membrane material as possible.

Alternatively or additionally, a liquid or solid substance can be provided in the combustion chamber 68. Here, a suitable substance is a substance that transits quickly into gaseous phase. For example dry ice can be selected, but also tetrazene, or even water, which has the advantage of producing steam that works very well as it evaporates. Its effect can be further increased when the amount of water in the combustion chamber is adjusted in such a way that a boiling delay will occur during the combustion of the pyrotechnic material.

These embodiments make it possible to achieve a particularly rapid disconnection of the switch 10, as well as to provide a reliable device while using only a few individual parts and to ensure that a good external seal will be created with little effort, and moreover, that a switch can be manufactured in a cost-effective manner.

Figure 8:
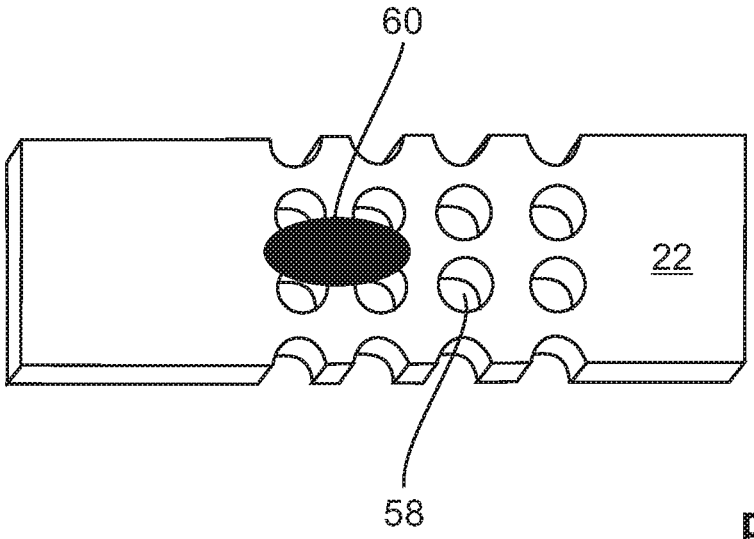
FIG. 8 shows an enlarged view of a preferred connecting element (only in the connecting position).

FIG. 8 shows a practical connecting element 22. This connecting element 22 is essentially designed as a melting belt. Such a melting belt can be provided in one or in several regions with one or with a plurality of bores 58. However, it is also possible to use other mechanically weakened points instead of bores, for example recesses or notches of any kind and form, as well as constrictions. Such elements result in an increased current density in the corresponding regions. This in turn causes heating of the connecting element 22, so that this can cause melting of the connecting element 22. Alternatively or additionally to the melting process, an explosive process can be also triggered by the heat. In addition, the pyro element 60 can be also provided in local proximity to the structure weakening elements, which is to say in particular in proximity to the bores 58. Such a connecting element 22 is more effective in the range of higher direct voltages and alternating voltages than a conventional fuse wire. Moreover, When multiple bores 58 are provided, or also when several regions having bores 58 (or corresponding weakening points) are provided, this can also be combined with the formation of several separating distances. As was already mentioned, the formation of a plurality of shorter separating distances is advantageous when compared to one long separating distance because similarly to the in series connection of resistors, only a fraction of the electrical voltage is then applied between the contacts 28 and 30 per separating distance, and it is thus much easier to cool or extinguish the correspondingly weaker light arcs occurring in this manner.

Figure 9A:
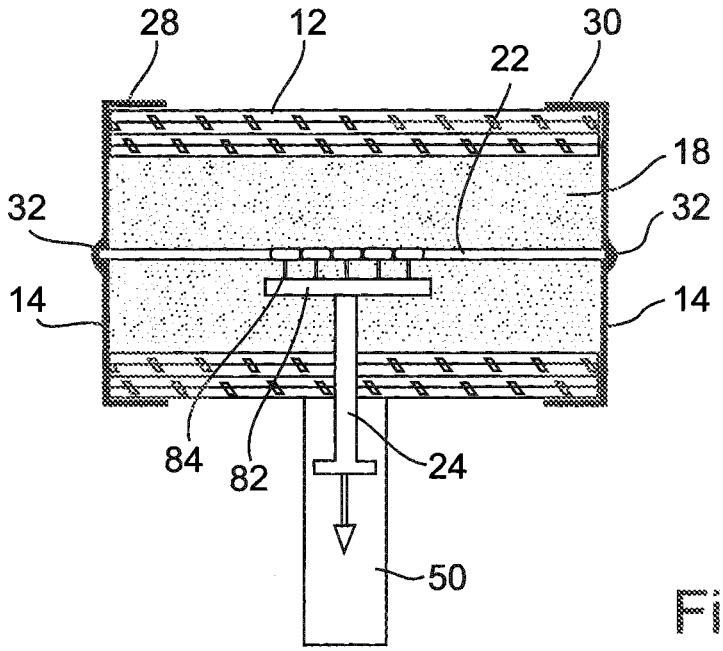
FIG. 9 shows another embodiment of the invention, in which the switching piston is moved perpendicularly to the connecting element.
Figure 9B:
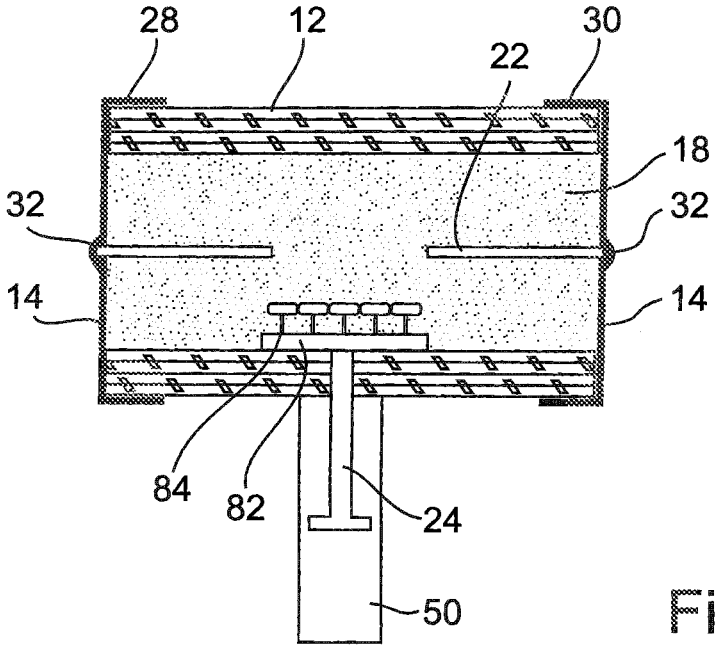

FIG. 9 shows another embodiment of the switch 10 according to the known view. This embodiment is again equipped with a cylindrical housing 12 that is provided with a housing base 14 and a housing cover 16. The interior space 18 of the housing 12 is filled with an insulating medium 20. In the insulating medium 20 is arranged a connecting element 22, which is connected with a switching piston 24. However, the switching piston 24 is arranged here perpendicularly to the connecting element 22. A separating distance is therefore created so that the sections of the connecting element 22 are shifted at an angle to the direction of the main extension of the connecting element (which is usually quickly ruptured). A practical angle is in this case in the range between 5° and 90°, although only the angle of 90° is shown here.

For the switching piston 24 is in this case provided a piston housing 50 which is placed at right angle on the cylindrical wall of the housing 12.

The switching piston 24 generates multiple separation points in the connecting element 22. For this purpose, the switching piston is connected with a collector 82, which in turn is connected by a connector 84 (designed as a connecting hook) with the connecting element 22 acting on the connecting element. A location with multiple separations can thus be created, wherein many small separating distances can be formed in a predetermined manner.

A robust disconnecting switch can thus be produced in the described manner inexpensively, which can be triggered manually with only minor modifications, while it can be also controlled remotely, which is to say triggered in this manner.

LIST OF REFERENCE SYMBOLS

10 switch
12 housing
14 housing base
16 housing cover
18 interior space
20 insulating medium
22 connecting element
24 switching piston
26 switching piston guide
28 first contact
30 second contact
32 anchor point
34 receptacle
36 contact point
38 contact wire
40 folding bellows
42 electrical feed-through
44 grip area
46 gripping ring
48 end plate
50 piston housing
52 cavity
54 front wall/front surface
56 induction coil
58 bore
60 pyro element
62 sensor wire
64 leaf spring
66 Pyroseele
68 combustion chamber
70 ignition connection
72 wall opening
74 pins, visual element
78 membrane support
80 ignition element
82 collector
84 connector
t separating distance

What is claimed is:

1. A switch (10) for disconnecting switch (10) for high direct and alternating currents at high voltages which can be transferred from a conducting position to a disconnecting position, comprising:

a housing (12), a first contact (28), a second contact (30), a switching piston (24) guided by the housing (12), and a connecting element (22) for creating an electrical connection between the first contact (28) and the second contact (30), the housing (12) defining an interior space surrounding the connecting element (22), the connecting element (22) extending at least in sections in the interior space (18), the interior space (18) filled with an insulating medium (20), the switch configured such that a mechanical movement of the switching piston (24) transfers the switch (10) from the conducting position into the disconnecting position, and wherein the switching piston (24) acts mechanically on the connecting element (22) to interrupt the electrical connection between the first contact (28) and the second contact (30) at least in one separating location, wherein the switching piston (24) is moved by a pulling movement by means of a drive, the drive being arranged outside of the interior space (18) of the housing (12) of the switch (10) for moving the switching piston (24) and impacting the switching piston (24) after an activation of the drive with a movement force causing movement of the switching piston, and wherein the drive is designed as an inductive drive, as an eddy current drive, or as a gas pressure drive, which generates gas pressure by means of a gas generating material, the connecting element (22) including a fuse comprised of a small tube, a wire, a flat element, or an element in a form of a belt for protecting the switch from overloading.

2. The switch according to claim 1, wherein the gas pressure drive is provided with a combustion chamber (68) separated from an inner space (18) of the housing (12) and including the gas generating material, and wherein the switching piston is designed such that it can be directly impacted by gas pressure to generate the movement of the switching piston, or wherein the switching piston can be impacted indirectly by the gas pressure, so that an element that is moved by gas pressure impacts the switching piston.

3. The switch according to claim 2, wherein a volume available in the combustion chamber (68) that is not used by the gas generating material is filled with a liquid or solid.

4. The switch according to claim 1, wherein the insulating medium (20) is a silicate or a mineral or quartz sand.

5. The switch according to claim 1, wherein the mechanical movement of the switching piston (24) for transferring the switch (10) from the conducting position into the disconnecting position is a translatory motion in a direction along a main extension of the connecting element (22), or a movement at an angle in a range from 5° to 90° to the direction of the main extension of the connecting element (22).

6. The switch according to claim 5, wherein the translatory motion of the connecting element (22) ruptures or severs the connecting element (22) from the first contact (28) and/or the second contact (30) at a position of rupture or a position of severed electrical contact, wherein the translatory motion of the switching piston (24) is continued through the position of rupture or through the position of severed electrical contact.

7. The switch according to claim 1, wherein the connecting element is designed as a fusible element so that the switch (10) will be transferred with a certain electrical load without the movement of the switching piston (24) into the disconnecting position, wherein a simultaneous or subsequent movement of the switching piston (24) increases a separating distance (t).

8. The switch according to claim 1, wherein the connecting element (22) is provided with at least one mechanically weakened cross-section, in order to define geometrically at least one disconnecting position.

9. The switch according to claim 1, wherein the gas pressure drive is provided with a membrane (76), which becomes deformed during the activation of the gas pressure drive, and wherein the switching piston (24) is mechanically connected with the membrane (76) so that a movement of the membrane is transferred to the switching piston (24).

10. The switch according to claim 9, further comprising a membrane supporting element which limits the movement of the membrane as a result of the gas pressure in at least one or in a plurality of partial areas.

11. The switch according to claim 9, wherein the membrane consists of a plurality of material layers overlaid one upon another.

12. The switch according to claim 1, wherein the connecting element (22) is provided with one or a plurality of electrically weakened cross-sections so as to reach with a certain overload amount the disconnection of the connecting element due to overload current, and wherein two or more electrically effectively weakened cross-sectional regions, which, however, are spatially separated from each other, can be arranged one behind another in the longitudinal direction of the connecting element (22), in order to achieve a correspondingly reduced switching voltage relative to an external source voltage applied to the switch (10) with a desired overload affecting one or multiple disconnecting locations.

13. The switch according to claim 1, wherein a pyrotechnic material (6) is mounted on the connecting element (22) for triggering or supporting formation of the disconnecting position, or wherein the connecting element is provided with a cavity (52) acting as a combustion chamber (58) into which the pyrotechnic material is introduced, wherein a volume of the combustion chamber that is not used up by the gas generating material is filled with a liquid or solid filler in order to reduce an empty volume in the combustion chamber and at the same time couple a pressure wave generated by an ignition element (80) with an improved, small attenuation on a membrane (76).

14. The switch according to claim 1, wherein the drive is configured to generate the gas pressure by combustion or oxidation of a liquid and/or solid gas generating material.

* * * * *